US012569007B2

(12) United States Patent
Xie et al.

(10) Patent No.: US 12,569,007 B2
(45) Date of Patent: Mar. 10, 2026

(54) E-CIGARETTE VAPORIZER AND E-CIGARETTE

(71) Applicant: SHENZHEN FIRST UNION TECHNOLOGY CO., LTD., Shenzhen City (CN)

(72) Inventors: Yuanqiu Xie, Shenzhen City (CN); Linhai Lu, Shenzhen City (CN); Ruilong Hu, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 668 days.

(21) Appl. No.: 18/011,160

(22) PCT Filed: Jun. 16, 2021

(86) PCT No.: PCT/CN2021/100394
§ 371 (c)(1),
(2) Date: Dec. 16, 2022

(87) PCT Pub. No.: WO2021/254401
PCT Pub. Date: Dec. 23, 2021

(65) Prior Publication Data

US 2023/0240360 A1 Aug. 3, 2023

(30) Foreign Application Priority Data

Jun. 16, 2020 (CN) ..... 202010545792.6

(51) Int. Cl.
*A24F 40/10* (2020.01)
*A24F 40/42* (2020.01)
(Continued)

(52) U.S. Cl.
CPC ..... *A24F 40/10* (2020.01); *A24F 40/42* (2020.01); *A24F 40/46* (2020.01); *A24F 40/485* (2020.01)

(58) Field of Classification Search
CPC ..... A24F 40/48; A24F 40/44; A24F 40/40; A24F 40/10
See application file for complete search history.

(56) References Cited

U.S. PATENT DOCUMENTS

2017/0172210 A1 6/2017 Bright et al.
2020/0138115 A1 5/2020 Pettitt et al.
2025/0091284 A1* 3/2025 Choi ..... B29C 63/0043

FOREIGN PATENT DOCUMENTS

CN 103750569 A 4/2014
CN 207653589 U 7/2018
(Continued)

OTHER PUBLICATIONS

Office Action dated Jul. 6, 2025 received in Chinese patent Application No. 202010545792.6.

*Primary Examiner* — Alex B Efta
(74) *Attorney, Agent, or Firm* — Scully, Scott, Murphy & Presser, P.C.

(57) ABSTRACT

This application provides an e-cigarette vaporizer and an e-cigarette. The vaporizer includes a liquid storage cavity, configured to store a liquid substrate; an air channel, providing a flowing path for external air to enter the liquid storage cavity and provided with a communication opening for the external air to enter the liquid storage cavity; and a sealing element, including a blocking part sealing the communication opening, where the blocking part is configured to open at least a part of the communication opening in response to a change of a negative pressure in the liquid storage cavity for the external air to enter the liquid storage cavity. A flexible component can open the air channel in
(Continued)

response to the change of the negative pressure in the liquid storage cavity due to flexibility, so that the external air can enter the liquid storage cavity to reduce the negative pressure.

19 Claims, 11 Drawing Sheets

(51) Int. Cl.
*A24F 40/46* (2020.01)
*A24F 40/485* (2020.01)

(56) References Cited

FOREIGN PATENT DOCUMENTS

| | | | |
|---|---|---|---|
| CN | 110250583 | A | 9/2019 |
| CN | 209498584 | U | 10/2019 |
| CN | 110613166 | A | 12/2019 |
| CN | 110916593 | A | 3/2020 |
| CN | 111011932 | A | 4/2020 |
| CN | 210611013 | U | 5/2020 |
| CN | 212852491 | U | 4/2021 |
| JP | 2003-251826 | A | 9/2003 |
| WO | 2020/023535 | A1 | 1/2020 |

* cited by examiner

E-CIGARETTE VAPORIZER AND E-CIGARETTE

CROSS-REFERENCE TO RELATED APPLICATIONS

This application is a 35 U.S.C. § 371 National Phase conversion of International (PCT) Patent Application No. PCT/CN2021/100394, filed on Jun. 16, 2021, which claims priority to Chinese Patent Application No. 202010545792.6, entitled "E-CIGARETTE VAPORIZER AND E-CIGARETTE" filed with the China National Intellectual Property Administration on Jun. 16, 2020, which is incorporated herein by reference in its entirety. The PCT International Patent Application was filed and published in Chinese.

TECHNICAL FIELD

Embodiments of this application relate to the field of e-cigarette technologies, and in particular, to an e-cigarette vaporizer and an e-cigarette

BACKGROUND

There are aerosol-providing articles, for example, e-cigarette devices. The devices generally include e-liquid. The e-liquid is heated to be vaporized, so as to generate an inhalable vapor or aerosol. The e-liquid may include nicotine and/or ultraviolet fragrance and/or an aerosol-generation article (for example, glycerol).

An existing e-cigarette device generally includes a porous ceramic body that has a large amount of micropores provided inside and is configured to absorb and conduct the e-liquid, and a heating element is arranged on a surface of the porous ceramic body and configured to heat and vaporize the absorbed e-liquid. The micropores in the porous body are used as channels for the e-liquid to infiltrate and flow to a vaporization surface, and also used as air exchange channels for air to replenish and enter a liquid storage cavity from the outside to maintain balance of the air pressure in the liquid storage cavity after the e-liquid in the liquid storage cavity is consumed, so that bubbles are generated in the porous ceramic body when the e-liquid is heated, vaporized, and consumed, and then the bubbles emerge from a liquid absorbing surface and then enter the liquid storage cavity.

For the existing e-cigarette device, as the e-liquid in the liquid storage cavity arranged inside is consumed, the liquid storage cavity is gradually in a negative pressure state, to prevent fluid transmission to a certain extent, so that the e-liquid is less conveyed to the vaporization surface through the micropore channels of the porous ceramic body for vaporization. Particularly, when the existing e-cigarette device is in a continuous inhaling and use state, the air outside the liquid storage cavity is difficult to pass through the micropore channels of the porous ceramic body to enter the liquid storage cavity in a short time, to slow down the speed of conveying the q-liquid to the vaporization surface, and insufficient e-liquid supplied to the heating element will cause the temperature of the heating element to be excessively high, resulting in decomposition and volatilization of the e-liquid components to generate harmful substances such as formaldehyde.

SUMMARY

In order to resolve the problems in the prior art that a negative pressure formed in an e-cigarette liquid storage cavity during use affects e-liquid conveying, embodiments of this application provide an e-cigarette vaporizer for promoting smooth transmission of e-liquid and an e-cigarette.

Based on the foregoing, this application provides an e-cigarette vaporizer, including a liquid storage cavity configured to store a liquid substrate; further including:

an air channel, providing a flowing path for external air to enter the liquid storage cavity and provided with a communication opening for the external air to enter the liquid storage cavity; and a sealing element, including a blocking part sealing the communication opening, where the blocking part is configured to open at least a part of the communication opening in response to a change of a negative pressure in the liquid storage cavity for the external air to enter the liquid storage cavity.

In a preferred implementation, the blocking part is configured to generate elastic deformation in response to the change of the negative pressure in the liquid storage cavity and open the at least a part of the communication opening during deformation.

In a preferred implementation, the blocking part of the sealing element is easier to deform than other parts of the sealing element.

In a preferred implementation, the blocking part of the sealing element is thinner than the other parts of the sealing element, so that the blocking part is easier to deform.

In a preferred implementation, the blocking part is configured into a wave shape extending along a surface of the communication opening, so that the blocking part is easier to deform.

In a preferred implementation, a strength-reducing structure for reducing an anti-bending strength of the blocking part is arranged on the sealing element, so that the blocking part is easier to deform.

In a preferred implementation, the strength-reducing structure includes a first through hole, groove, or notch adjacent to or surrounding the blocking part.

In a preferred implementation, the first through hole, groove, or notch avoids the communication opening.

In a preferred implementation, the e-cigarette vaporizer further includes: a heating element configured to heat the liquid substrate to generate the aerosol, where a first liquid channel for the liquid substrate to flow from the liquid storage cavity to the heating element is provided on the sealing element; and the blocking part is adjacent to the first liquid channel.

In a preferred implementation, the first liquid channel extends outwards in a radial direction to form the first through hole, groove, and notch.

In a preferred implementation, the strength-reducing structure includes a recess arranged on the blocking part.

In a preferred implementation, the deformation includes tilting or bending or protruding in a direction deviating from the communication opening.

In a preferred implementation, a cut or a slit that is enlarged when the blocking part is elastically deformed is provided on the blocking part.

In a preferred implementation, the blocking part is hung relative to the other parts of the sealing element.

In a preferred implementation, the e-cigarette vaporizer further includes:

a porous body, provided with a liquid absorbing surface that is in fluid communication with the liquid storage cavity and absorbs the liquid substrate and a vaporization surface for the aerosol to release and escape; and a vaporization chamber, at least partially defined by the vaporization surface and in airflow communication with the external air, where the air channel is in airflow communication with the vaporization chamber, to allow air in the vaporization chamber to enter the liquid storage cavity during use.

In a preferred implementation, the e-cigarette vaporizer further includes:

a suction nozzle, for a user to inhale; and a vapor output channel, configured to output the aerosol to the suction nozzle, where the air channel is in airflow communication with the vapor output channel, to allow air in the vapor output channel to enter the liquid storage cavity during use.

In a preferred implementation, the e-cigarette vaporizer further includes:

a porous body, provided with a liquid absorbing surface that is in fluid communication with the liquid storage cavity and absorbs the liquid substrate and a vaporization surface for the aerosol to release and escape; and a support frame, configured to accommodate and hold the porous body, where the sealing element is configured into at least a part of an outer surface surrounding the support frame; and the air channel is formed on the support frame or formed between the sealing element and the support frame.

In a preferred implementation, a second through hole extending in a length direction of the vaporizer is provided on the support frame, and the air channel is formed by the second through hole; and the second through hole and an end portion opposite to the liquid storage cavity form the communication opening; and/or a first groove extending in a length direction of the vaporizer is provided on an outer side wall of the support frame, and the air channel is formed between the first groove and the sealing element; and the groove and an end portion opposite to the liquid storage cavity form the communication opening; and/or a ridge extending in a length direction of the vaporizer is arranged on an outer side wall of the support frame, and a gap is kept between the support frame and the sealing element by using the ridge to form the air channel; and the gap and an end portion opposite to the liquid storage cavity form the communication opening.

In a preferred implementation, the e-cigarette vaporizer further includes:

a porous body, provided with a liquid absorbing surface that is in fluid communication with the liquid storage cavity and absorbs the liquid substrate and a vaporization surface for the aerosol to release and escape; and a support frame, including:

an accommodating cavity, where the porous body is accommodated and maintained in the accommodating cavity; and a second liquid channel, where one end of the second liquid channel is in fluid communication with the liquid storage cavity, and an other end of the second liquid channel is in fluid communication with the liquid absorbing surface of the porous body, so that the liquid substrate in the liquid storage cavity is conveyed to the liquid absorbing surface of the porous body through the second liquid channel and absorbed by the liquid absorbing surface when the second liquid channel is used, where a first end of the air channel is in communication with the second liquid channel, and a second end of the air channel is in communication with the external air, so that the external air passes through the air channel and the second liquid channel and then enters the liquid storage cavity when the air channel is used.

In a preferred implementation, the air channel includes a second groove formed on an inner surface of the accommodating cavity, and one end of the second groove is in communication with the second liquid channel and an other end of the second groove is in communication with the external air.

In a preferred implementation, the sealing element is configured into at least a part of an outer surface in the accommodating cavity and wrapping the porous body.

In a preferred implementation, the e-cigarette vaporizer further includes:

a suction nozzle, for a user to inhale; and a vapor output channel, configured to output the aerosol to the suction nozzle, where the second end of the air channel is in airflow communication with the vapor output channel and then is in airflow communication with the external air.

In a preferred implementation, the blocking part is configured to overlap with at least a part of the vapor output channel in an axial direction of the vaporizer.

In a preferred implementation, the porous body includes a support part extending in a cross section direction of the vaporizer; and the blocking part covers a surface of the support part.

In a preferred implementation, at least a part of the blocking part protrudes relative to the other parts of the sealing element in the length direction of the vaporizer.

In a preferred implementation, the air channel includes a third through hole running through from the vaporization surface to the liquid absorbing surface; and/or the air channel includes a groove or a gap between the porous body and a flexible element.

In a preferred implementation, a thickness of the blocking part is between 0.2 mm and 0.5 mm and has a Shore Hardness A ranging from 20 A to 40 A.

In a preferred implementation, at least a part of the sealing element is configured to have a specific deformation resistance capability, so that an air pressure in the liquid storage cavity is less than an external air pressure.

This application further provides an e-cigarette, including a vaporization apparatus and a power supply device for supplying power to the vaporization apparatus, where the vaporization apparatus includes the foregoing e-cigarette vaporizer.

According to the vaporizer and the e-cigarette, a flexible component can open the air channel in response to the change of the negative pressure in the liquid storage cavity due to flexibility, so that the external air can pass through the air channel and enter the liquid storage cavity to reduce the negative pressure to a certain extent, so as to smoothly convey the liquid substrate.

Another embodiment of this application further provides an e-cigarette vaporizer, including:

a porous body and a support frame configured to accommodate and hold the porous body, where the porous body has a first direction, a second direction perpendicular to the first direction, and a third direction perpendicular to the first direction and the second direction; the porous body includes a base part, where the base part is arranged parallel to the second direction and the third direction and is provided a liquid absorbing surface and a vaporization surface that face away from each other in the first direction; and the porous body further includes a first extending arm and a second extending arm that extend away from the vaporization surface from the base part and a support part extending between the first extending arm and the second extending arm, where the first extending arm and the second extending arm are parallel to the second direction and are oppositely arranged in the third direction; and a sealing element, arranged between the support frame and the porous body and configured to seal a gap between the support frame and the porous body, where the sealing element is provided with a communication opening in fluid communication with the liquid absorbing surface; the sealing element includes a plurality of side walls wrapping the porous body in a circumferential direction of the porous body and an upper end wall at least partially opposite to the support part;

the sealing element includes a plurality of convex ribs extending on the plurality of side walls and an outer surface of the upper end wall, where the plurality of convex ribs are connected to form at least one closed ring; and the communication opening is located in the at least one closed ring.

In a preferred implementation, the plurality of convex ribs are symmetrical in the second direction and/or the third direction.

In a preferred implementation, the side walls include: a first side wall and a second side wall that are respectively arranged on two sides of the base part in the first horizontal direction; and a third side wall and a fourth side wall that are respectively arranged on two sides of the base part in the second horizontal direction; and the plurality of convex ribs include at least a first convex rib, arranged on outer surfaces of the first side wall and the second side wall and opposite to at least a part of the base part in the second direction;

a second convex rib, arranged on an outer surface of the upper end wall;

a third convex rib, arranged on an outer surface of the third side wall and opposite to at least a part of the first extending arm in the third direction; and a fourth convex rib, arranged on an outer surface of the fourth side wall and opposite to at least a part of the second extending arm in the third direction, where the first convex rib, the second convex rib, the third convex rib, and the fourth convex rib are connected to form the at least one closed ring.

In a preferred implementation, the first convex rib is configured to extend in the third direction.

In a preferred implementation, at least a part of the third convex rib and/or the fourth convex rib is obliquely arranged.

In a preferred implementation, the first convex rib includes a first section arranged on the first side wall and a second section arranged on the second side wall;

the second convex rib includes a third section and a fourth section that are opposite to each other in the third direction, where the third section is arranged close to the third side wall, and the fourth section is arranged close to the fourth side wall;

the third convex rib includes a fifth section and a sixth section that are opposite to each other in the second direction, where the fifth section is arranged close to the first side wall, and the sixth section is arranged close to the second side wall; and the fourth convex rib includes a seventh section and an eighth section that are opposite to each other in the second direction, where the seventh section is arranged close to the first side wall, and the eighth section is arranged close to the second side wall; and the first section, the fifth section, the third section, the sixth section, the second section, the eighth section, the fourth section, and the seventh section are connected end to end sequentially to form a closed ring.

In a preferred implementation, the third section and/or the fourth section extends in the second direction.

In a preferred implementation, the first convex rib includes a first section arranged on the first side wall and a second section arranged on the second side wall;

the second convex rib includes a third section and a fourth section that are opposite to each other in the second direction, where the third section is arranged close to the first side wall, and the fourth section is arranged close to the second side wall; and the third convex rib includes a fifth section and a sixth section that are opposite to each other in the second direction, where the fifth section is arranged close to the first side wall, and the sixth section is arranged close to the second side wall; and the fourth convex rib includes a seventh section and an eighth section that are opposite to each other in the second direction, where the seventh section is arranged close to the first side wall, and the eighth section is arranged close to the second side wall;

the first section, the fifth section, the third section, and the seventh section are connected end to end sequentially to form a first closed ring; and the second section, the sixth section, the fourth section, and the eighth section are connected end to end sequentially to form a second closed ring.

In a preferred implementation, the fifth section and/or the sixth section extends in the third direction.

In a preferred implementation, the e-cigarette vaporizer further includes a vapor output channel, where a through hole opposite to the vapor output channel in the first direction is provided on the upper end wall; and the third section and the fourth section are respectively arranged on two sides of the through hole.

In a preferred implementation, the support part is parallel to the base part; and/or the first extending arm and the second extending arm are parallel to the first direction.

This application further provides an e-cigarette, including a vaporization apparatus and a power supply device for supplying power to the vaporization apparatus, where the vaporization apparatus includes the foregoing e-cigarette vaporizer.

The e-cigarette vaporizer adopts a structure correspondingly applicable to the arched porous body with the support part, the convex ribs corresponding to parts of the porous body are arranged on a flexible silicone sleeve, and the convex ribs are connected to each other to form a closed ring that can surround the communication opening, so that after being assembled, the convex ribs can relatively completely and tightly abut against a rigid support frame and seal a gap between the support frame at the periphery of the communication opening and the porous body to isolate the liquid channel, thereby preventing the liquid substrate from leaking through the gap and improving a sealing effect.

BRIEF DESCRIPTION OF THE DRAWINGS

One or more embodiments are exemplarily described with reference to the corresponding figures in the accompanying drawings, and the descriptions are not to be construed as limiting the embodiments. Components in the accompanying drawings that have same reference numerals are represented as similar components, and unless otherwise particularly stated, the figures in the accompanying drawings are not drawn to scale.

One or more embodiments are exemplarily described with reference to the corresponding figures in the accompanying drawings, and the descriptions are not to be construed as limiting the embodiments. Components in the accompanying drawings that have same reference numerals are represented as similar components, and unless otherwise particularly stated, the figures in the accompanying drawings are not drawn to scale.

DETAILED DESCRIPTION

For ease of understanding of this application, this application is described below in more detail with reference to accompanying drawings and specific implementations.

Figure 1:
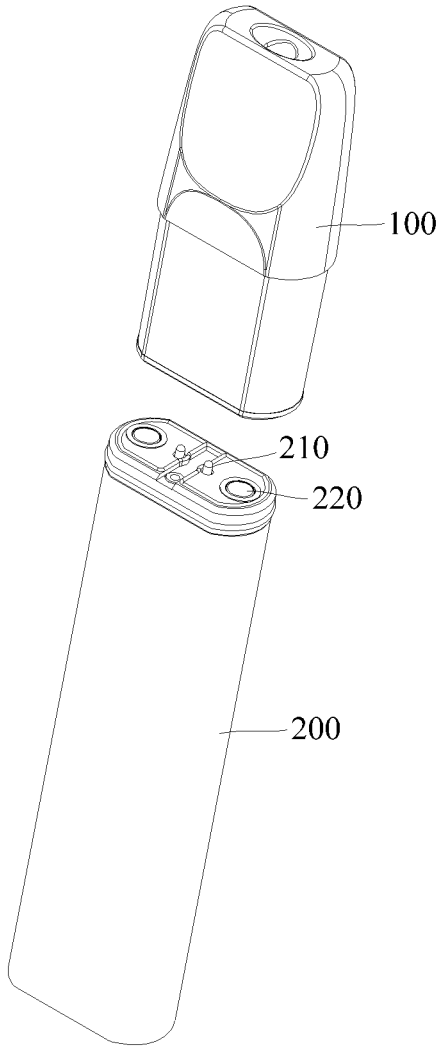
FIG. 1 is a schematic structural diagram of an e-cigarette according to an embodiment.
Figure 2:
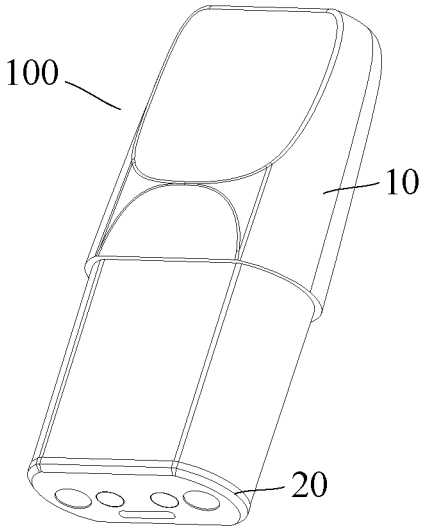
FIG. 2 is a schematic structural diagram of a vaporizer shown in FIG. 1 from another perspective.

The embodiments of this application provide a kind of e-cigarette product in which a liquid substrate is heated and vaporized. In an embodiment, a flat e-cigarette shown in FIG. 1 and FIG. 2 is usually used as an example for description and includes a vaporizer 100 for vaporizing a liquid substrate and a power supply device 200 for supplying power to the vaporizer 100. A conductive pogo pin 210 correspondingly connected to the vaporizer 100 for electric conduction and a magnet 220 magnetically attracting a magnetic element on the vaporizer 100 are further respectively arranged on the power supply device 200.

Figure 3:
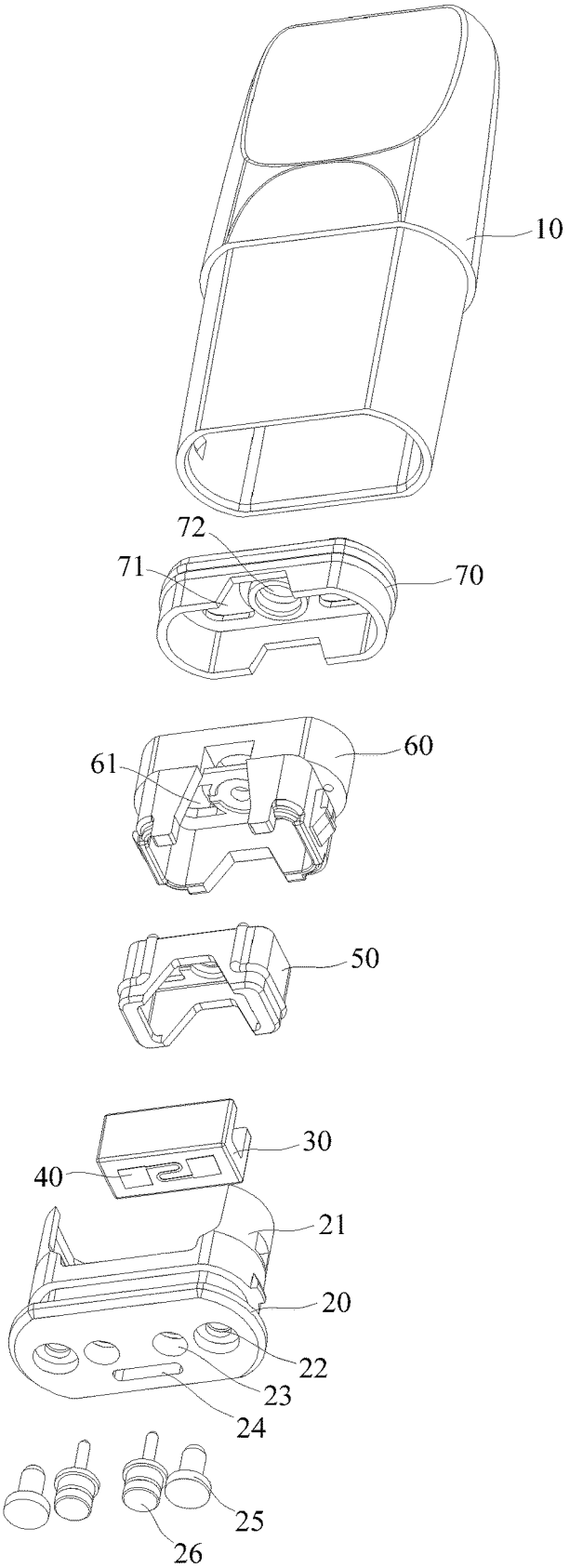
FIG. 3 is a schematic exploded view of the vaporizer shown in FIG. 2 from a perspective.
Figure 4:
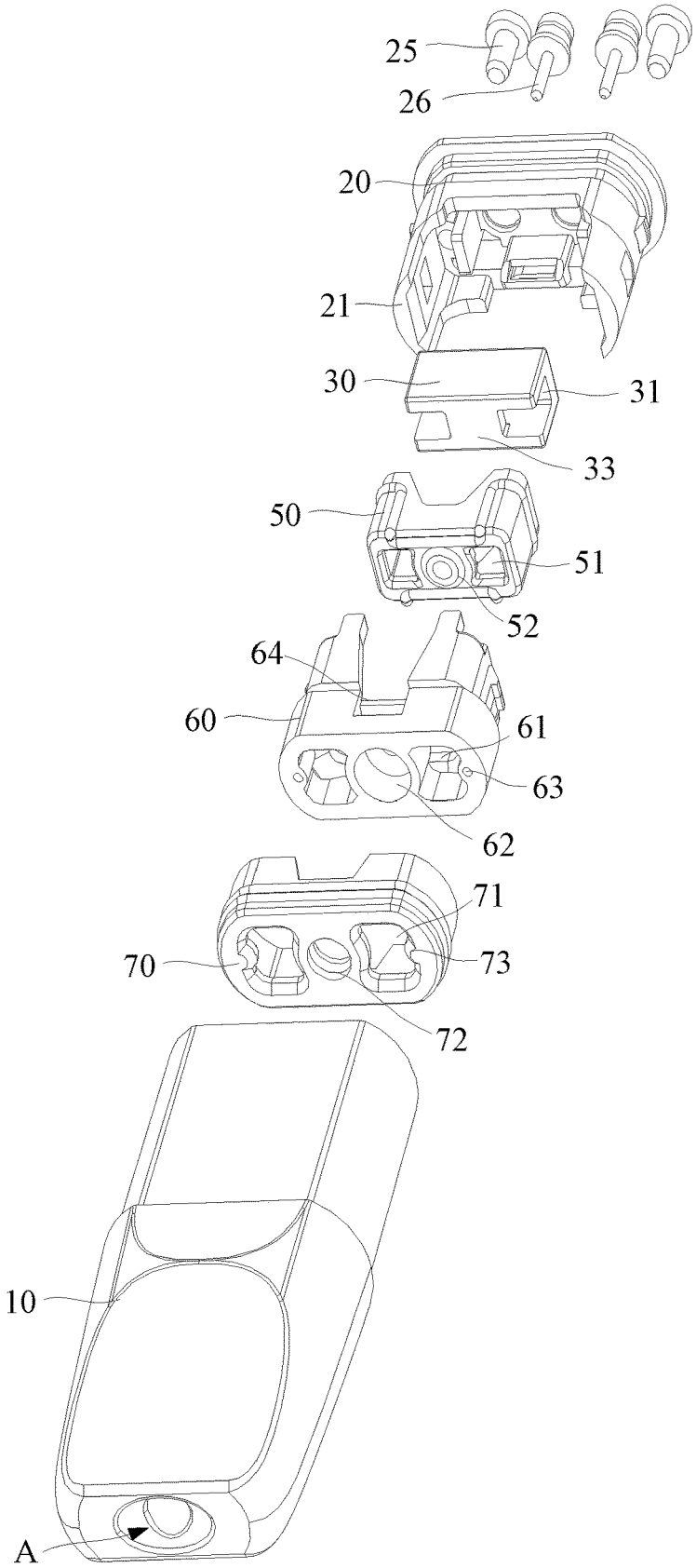
FIG. 4 is a schematic exploded view of the vaporizer shown in FIG. 2 from still another perspective.
Figure 5:
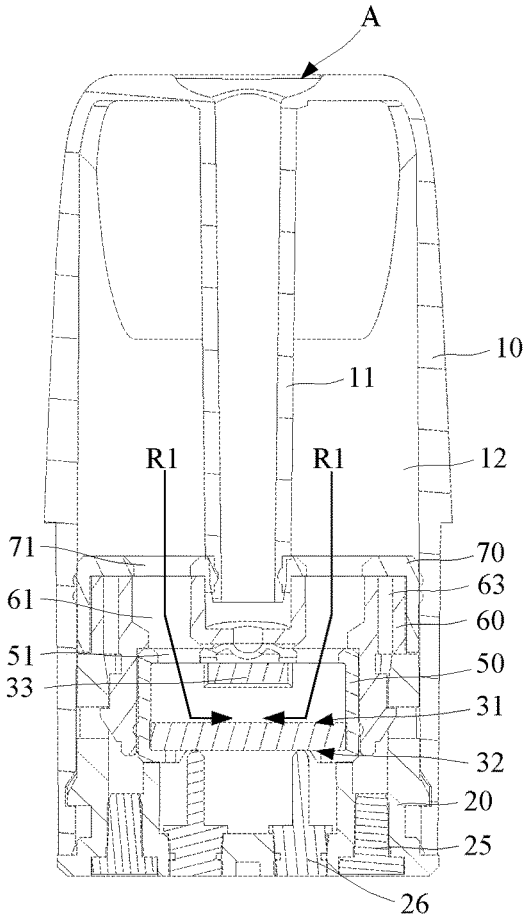
FIG. 5 is a schematic cross-sectional view of the vaporizer shown in FIG. 2 in a width direction.

For a detailed structure of the vaporizer 100, reference may be made to schematic exploded views of FIG. 3 and FIG. 4 and a schematic cross-section view of FIG. 5, and the vaporizer includes:

a hollow cylindrical outer housing 10, where the outer housing 10 includes a near end and a far end that are opposite to each in an axial direction. According to a common use requirement, the near end is configured as one end for a user to inhale aerosols, and a suction nozzle A for the user to inhale is arranged at the near end. The far end is used as one end fitted and connected to the power supply device 200, the far end of the outer housing 10 is an opening, and a detachable end cover 20 is mounted on the far end, which is convenient to open the opening and mount functional components inside the outer housing 10.

Further referring to FIG. 3 to FIG. 5, a liquid storage cavity 12 for storing the liquid substrate, a porous body 30 for absorbing the liquid substrate from the liquid storage cavity 12, and a heating element 40 for heating and vaporizing the liquid substrate absorbed by the porous body 30 are arranged inside the outer housing 10. Specifically, in a schematic cross-sectional structural diagram shown in FIG. 5, a vapor conveying tube 11 is arranged in an axial direction in the outer housing 10, and the liquid storage cavity 12 for storing the liquid substrate is formed in a space between an outer wall of the vapor conveying tube 11 and an inner wall of the outer housing 10. A first end of the vapor conveying tube 11 disposed at a relative near end is in communication with the suction nozzle A, and a second end disposed at a relative far end is in airflow communication with an aerosol generated through heating of the heating element 40, so that an aerosol generated by vaporizing the liquid substrate by using the heating element 40 is conveyed to the suction nozzle A for inhaling.

Referring to a structure of the porous body 30 shown in FIG. 3 to FIG. 5, a shape of the porous body 30 is configured into roughly, but not limited to, a block structure in this embodiment. According to a preferred design in this embodiment, the porous body is in an arched shape and is provided with a liquid absorbing surface 31 and a vaporization surface 32 that face away from each other in an axial direction of the outer housing 10, that is, an upper surface and a lower surface of a base portion part of the block porous body 30 in FIG. 3. The liquid absorbing surface 31 is opposite to the liquid storage cavity 12 and is in direct or indirect contact with the liquid substrate in the liquid storage cavity 12 to absorb the liquid substrate. A microporous structure inside the porous body 30 conducts the liquid substrate to the vaporization surface 32 for heating and vaporizing, to form the aerosol, and the aerosol is released or escapes from the vaporization surface 32. In terms of the structure of the porous body 30 shown in FIG. 5, because the liquid absorbing surface 31 is parallel to the vaporization surface 32, both moving directions of the liquid substrate and the aerosol in the porous body 30 are perpendicular to a plane in which the vaporization surface 32 is located. The aerosol and the liquid substrate move in the porous body 30 more smoothly and are relatively convenient to manufacture.

Further, to facilitate assembly and fixing, in the preferred embodiments shown in FIG. 3 to FIG. 5, the porous body 30 further includes a support part 33.

In some implementations, the porous body 30 may be made of a hard capillary structure such as a porous ceramic, a porous glass ceramic, or a porous glass. The heating element 40 is preferably formed on the vaporization surface 32 by mixing conductive raw material powder with a printing assistant to form a slurry and then sintering after printing, so that an entire or most surface of the heating element is closely attached to the vaporization surface 32, and the heating element has high vaporization efficiency, less heat loss, and a dry-burn prevention or dry-burn reduction effect. In some embodiments, the heating element 40 may be made of a material such as stainless steel, nickel chromium alloy, iron chromium aluminum alloy, or metal titanium.

Further referring to FIG. 3 to FIG. 5, to assist in mounting and fixing the porous body 30 and sealing the liquid storage cavity 12, a sealing mechanism is further arranged in the outer housing 10. The sealing mechanism includes a flexible silicone sleeve 50, a rigid support frame 60, and a flexible silicone base 70, to seal an opening of the liquid storage cavity 12 and fix and maintain the porous body 30 in the outer housing.

In terms of a specific structure and shape, the flexible silicone sleeve 50 is substantially ring-shaped and is hollow inside for accommodating the porous body 30 and is sleeved outside the porous body 30 through flexible tight fit.

The rigid support frame 60 holds the porous body 30 sleeved with the flexible silicone sleeve 50. In some embodiments, the rigid support frame may be substantially in a ring shape with a lower end being an opening, and an inner space thereof is used for accommodating and holding the flexible silicone sleeve 50 and the porous body 30.

The flexible silicone base 70 is arranged on an end portion of the liquid storage cavity 12 facing the far end, and a shape of the flexible silicone base matches a cross section of an inner contour of the outer housing 10, to seal the liquid storage cavity 12 and prevent the liquid substrate from leaking out from the liquid storage cavity 12. Further, to prevent shrinkage and deformation of the flexible silicone base 70 made of a flexible material from affecting the sealing tightness, the rigid support frame 60 is accommodated in the flexible silicone base 70 to support the flexible silicone base.

After mounting, to ensure smooth conveying of the liquid substrate and output of the aerosol, a first liquid guide channel 71 for the liquid substrate to flow through is provided on the flexible silicone base 70, a second liquid guide channel 61 is correspondingly provided on the rigid support frame 60, and a third liquid guide channel 51 is provided on the flexible silicone sleeve 50. During use, the liquid substrate sequentially passes through the first liquid guide channel 71, the second liquid guide channel 61, and the third liquid guide channel 51 and flows to the liquid absorbing surface 31 of the porous body 30 maintained in the flexible silicone sleeve 50, which is shown in an arrow R1 in FIG. 5, and then is absorbed and conveyed to the vaporization surface 32 for vaporization.

Figure 6:
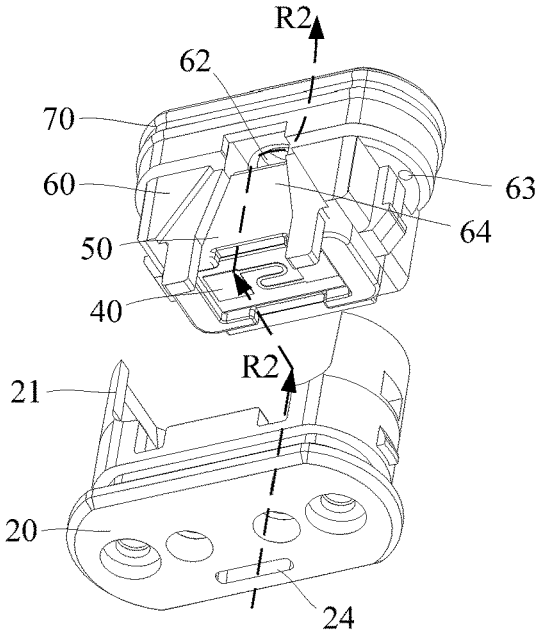
FIG. 6 is a schematic diagram of an airflow path in an inhalation process of the vaporizer shown in FIG. 2.

During inhalation, in terms of an output structure of the aerosol, a first insertion hole 72 for a lower end of the vapor conveying tube 11 to insert is provided on the flexible silicone base 70, a second insertion hole 62 is correspondingly provided on the rigid support frame 60, and one side of the rigid support frame 60 opposite to a side wall of the outer housing 10 is provided with a first airflow channel 64 for the vaporization surface 32 and the second insertion hole 62 to be in airflow communication. After mounting, as shown in an arrow R2 in FIG. 6, the aerosol generated by the heating element 40 passes through the first airflow channel 64 and flows to the second insertion hole 62, and then is outputted to the vapor conveying tube 11 through the first insertion hole 72.

Further, in terms of assisting in power supply and a mounting structure, referring to FIG. 3 to FIG. 6, a first support leg 21 is arranged on the end cover 20 and is configured to support and fix the sealing mechanism. Certainly, in this embodiment, the first support leg abuts against a lower end surface of the rigid support frame 60, to support the sealing mechanism. First mounting holes 22 and second mounting holes 23 are further provided on the end cover 20. The first mounting holes 22 are configured to mount magnetic elements 25 magnetically attached to magnets 220 on the power supply device 200, the second mounting holes 23 are configured to mount electrodes 26, and the electrodes 26 abut against two ends of the heating element 40 after passing through the second mounting holes 23, to supply power to the heating element 40. Certainly, after the vaporizer 100 is connected to the power supply device 200, the electrodes 26 are conductively connected to corresponding conductive pogo pins 210 on the power supply device 200. In addition, an air inlet hole 24 for the external air to enter the vaporizer 100 during inhalation is further provided on the end cover 20. Referring to R2 in FIG. 6, the external air flows to the vaporization surface 32 through the air inlet hole 24 and is outputted with an aerosol.

In this embodiment, a specific distance is maintained between the vaporization surface 32 and the end cover 20, and at least a part of a vaporization chamber is surrounded by the vaporization surface 32 and the end cover 20 and is formed for the aerosol to escape. Certainly, on one hand, the vaporization chamber is in airflow communication with the air inlet hole 24 on the end cover 20 and is configured for the external air to enter the vaporization chamber; and on the other hand, the vaporization chamber is in airflow communication with the vapor conveying tube 11 and is configured to output the aerosol generated by and escaping from the vaporization surface 32.

After a negative pressure vacuum is generated in the liquid storage cavity 12 with the consumption of the liquid substrate, to ensure that the liquid substrate can still be smoothly absorbed by the porous body 30, an air channel is also provided in the vaporizer 100. Further referring to FIG. 7 to FIG. 9, a through hole 63 running through in the axial direction of the vaporizer 100 is provided on the rigid support frame 60, and the air channel for replenishing the external air to the liquid storage cavity 12 is formed by the through hole 63. After being mounted, an upper end of the through hole 63 is blocked by a first blocking part 73 of the flexible silicone base 70, a lower end of the through hole is exposed without being blocked, and the lower end is in airflow communication with the vaporization chamber through a gap or a set channel to the end cover 20.

Further, a thickness and a position of the first blocking part 73 are designed, and the thickness is between 0.2 mm and 0.5 mm. In addition, in some embodiments, the first blocking part 73 is thinner than other parts of the flexible silicone base, so that the first blocking part 73 is easier to deform. In addition, hardness of a material used for the flexible silicone base 70 may range from 20 A to 40 A in Shore Hardness A. Therefore, after the negative pressure in the liquid storage cavity 12 is gradually increased, the pressure is transmitted through fluid, so that a pressure at an upper end of the first blocking part 73 is reduced, to allow the upper end of the first blocking part to tilt up and deform shown in FIG. 9, so as to expose a part of a gap at an upper end of the through hole 63 for the external air to enter the liquid storage cavity 12 along an arrow R3 in FIG. 9 to eliminate the negative pressure.

Figure 8:
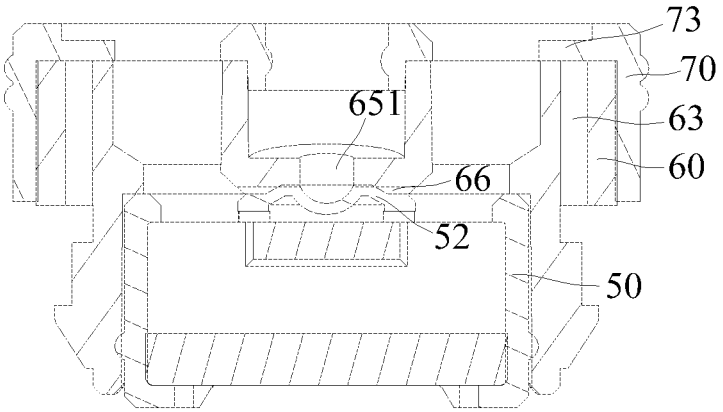
FIG. 8 is a schematic cross-sectional view after a support frame and a porous body are assembled.
Figure 9:
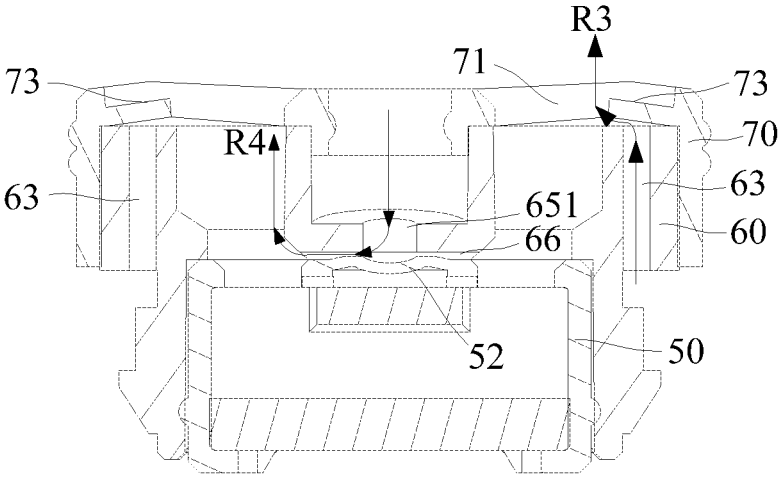
FIG. 9 is a schematic diagram in which external air enters a liquid storage cavity through an air channel.
Figure 14:
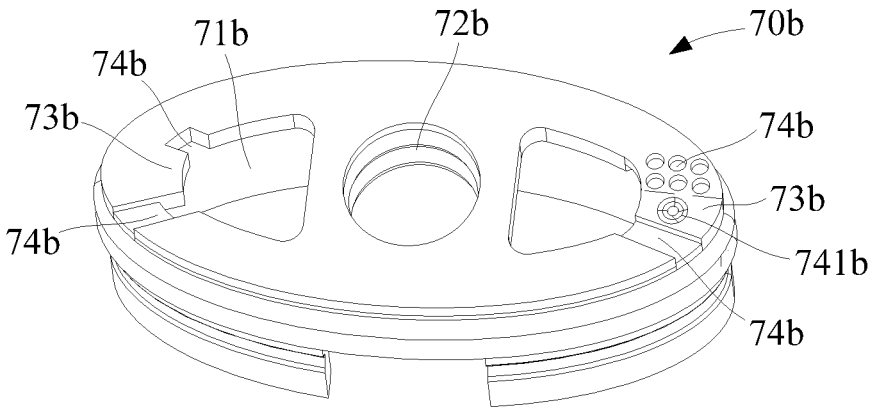
FIG. 14 is a schematic structural diagram of a flexible silicone base according to still another embodiment.

It can be learned from FIG. 4, FIG. 8, and FIG. 9 that the position of the first blocking part 73 of the flexible silicone base 70 is close to the first liquid guide channel 71, to reduce the anti-bending strength of the first blocking part 73 by providing the first liquid guide channel 71, so that the first blocking part 73 is easier to deform. Alternatively, a plurality of strength-reducing structures 74*b*/741*b* such as through holes, grooves, notches, or recesses surrounding the first blocking part 73 may be additionally provided, which can reduce the anti-bending strength of the first blocking part 73 and make it easier to tilt or deform, as shown in FIG. 14.

Figure 7:
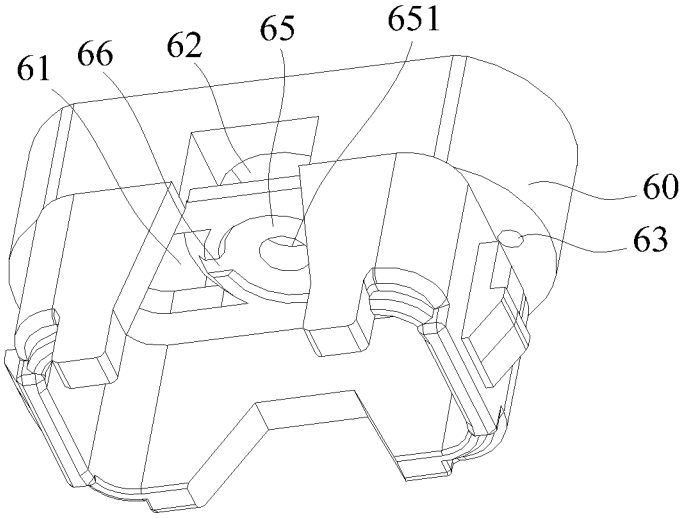
FIG. 7 is a schematic structural diagram of a support frame in FIG. 6 from a perspective.

In addition to a manner in which the first blocking part 73 is tightly attached to a surface of the opening of the through hole 63 for blocking, further referring to FIG. 7 to FIG. 9, a first recessed structure 65 is arranged on the rigid support frame 60. A through hole 651 opposite to a second insertion hole 62 is further provided in the first recessed structure 65, and the through hole 651 is in airflow communication with the second insertion hole 62 and is further in airflow communication with the air inlet hole 24 and even the external air. Therefore, subsequently, the negative pressure in the liquid storage cavity 12 may be eliminated by taking air into the liquid storage cavity 12 through the through hole 651. To assist airflow communication between the through hole 651 and the liquid storage cavity 12, a vent groove 66 is provided on the support frame 60, extends from the first recessed structure 65 to the second liquid guide channel 61, and is configured for air in the vapor conveying tube 11 to enter the air channel of the liquid storage cavity 12.

A second blocking part 52 that can extend into the first recessed structure 65 is correspondingly arranged on an upper end of the flexible silicone sleeve 50. After being mounted, the second blocking part 52 of the flexible silicone sleeve 50 extends upwards into the first recessed structure 65 to block the through hole 651 and certainly also block an opening of the vent groove 66, as shown in FIG. 8. Further, when the pressure in the liquid storage cavity 12 becomes the negative pressure, the pressure is transmitted through fluid, and the second blocking part 52 is deformed and retracts downwards to a state shown in FIG. 9, to expose a part of the blocked through hole 651 and a part of the opening of the vent groove 66, so that the through hole 651 is in communication with the liquid storage cavity 12 through the vent groove 66 for the external air to enter the liquid storage cavity 12 along an arrow R4 in FIG. 9, to reduce the negative pressure to a certain extent.

Figure 10:
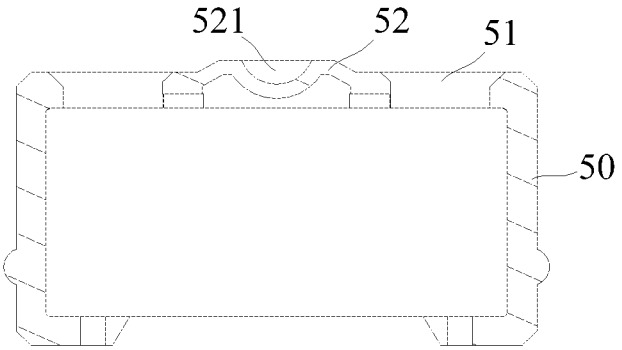
FIG. 10 is a schematic sectional structural view of a flexible silicone sleeve in FIG. 8.

In the design, referring to FIG. 10, the second blocking part 52 of the flexible silicone sleeve 50 is located between two third liquid guide channels 51, which is beneficial to deformation by reducing an anti-bending strength. In addition, a thickness of the second blocking part is reduced to about between 0.2 mm and 0.5 mm, and hardness of a material ranges from 20 A to 40 A in Shore Hardness A. In addition, to enable the second blocking part to have a larger deformation tendency under a relatively small pressure, the second blocking part 52 is not a plane shape but a concave-convex and fluctuant wave shape, and a second recessed structure 521 opposite to a protruding direction is arranged on the center of the second blocking part 52. The second recessed structure 521 is configured to reduce the thickness of the second blocking part 52 and further reduce the anti-bending strength, to more easily deform the second blocking part.

Figure 11:
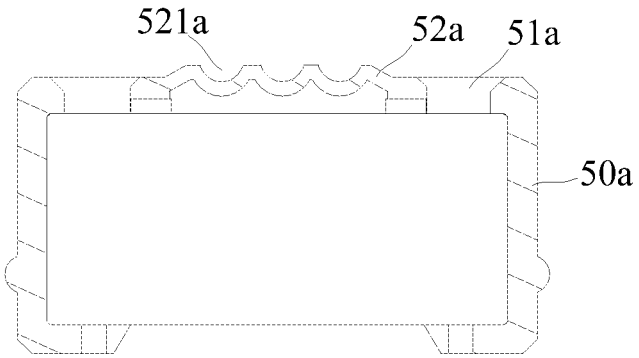
FIG. 11 is a schematic cross-sectional view of a flexible silicone sleeve according to still another embodiment.

Alternatively, in another embodiment of a flexible silicone sleeve 50*a* shown in FIG. 11, a plurality of second recessed structures 521*a* are arranged on a second blocking part 52*a* at least partially protruding relative to other parts of the flexible silicone sleeve, so that the second blocking part is in a wave shape extending in the cross section direction of the vaporizer 100, and the second recessed structure is configured to reduce an anti-bending strength of the second blocking part 52*a*, to more easily deform the second blocking part.

Figure 12:
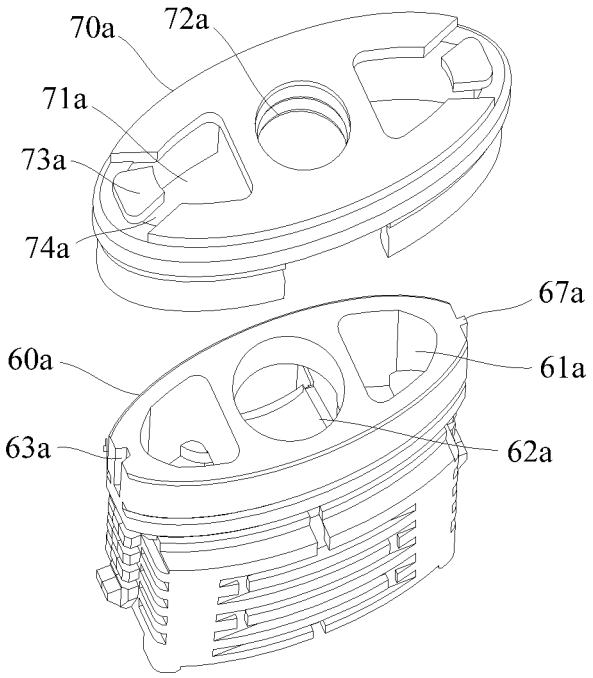
FIG. 12 is a schematic diagram of a rigid support cover and a flexible silicone base according to still another embodiment.
Figure 13:
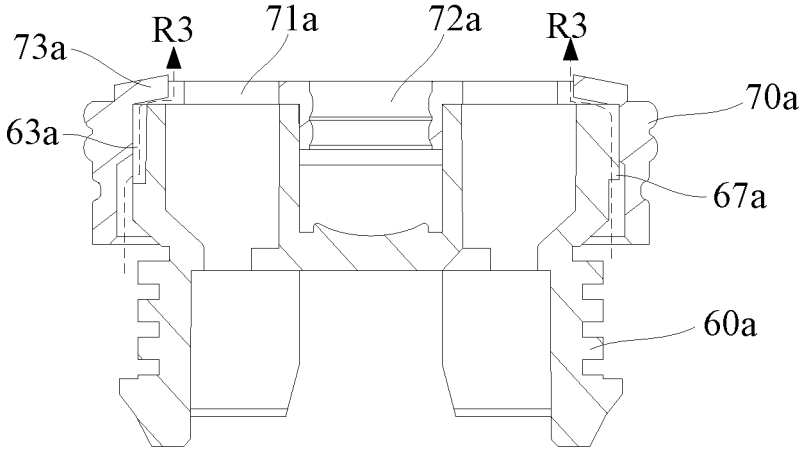
FIG. 13 is a schematic diagram in which the flexible silicone base is deformed to open an air channel in FIG. 12.

In still another variable embodiment shown in FIG. 12 and FIG. 13, an air channel is formed between a rigid support frame 60*a* and a flexible silicone base 70*a* for the external air to enter when the liquid storage cavity 12 is in the negative pressure. Specifically, in an embodiment, a groove 63*a* extending in a length direction is provided on an outer side wall of a first end of the rigid support frame 60*a* in a width direction. After the groove is mounted, the air channel is formed between the groove 63*a* and an inner wall of the flexible silicone base 70*a* for air in the vaporization chamber to enter the liquid storage cavity 12. A first blocking part 73*a* is correspondingly arranged on the flexible silicone base 70*a* to block an opening of the groove 63*a*, and the first blocking part 73*a* can slightly tilt or bend towards the liquid storage cavity 12 when the liquid storage cavity 12 is under the negative pressure to further open the opening of the groove 63*a*.

In FIG. 12 and FIG. 13, a ridge 67*a* extending in the length direction is arranged on an outer side wall of a second end of the rigid support frame 60*a* in the width direction. After being mounted, the ridge 67*a* makes it impossible to fully fit the outer side wall of the second end of the rigid support frame 60*a* with an inner wall of the flexible silicone base 70*a*, and a specific gap is maintained, so that the air channel for the external air to enter the liquid storage cavity 12 is formed by using the gap. Certainly, the first blocking part 73*a* opposite to the ridge 67*a* blocks an opening of the air channel formed by the ridge 67*a* and slightly tilts or bends towards the liquid storage cavity 12 when the liquid storage cavity 12 is under the negative pressure, to further open the opening of the air channel formed by the ridge 67*a*.

Further, in a preferred embodiment shown in FIG. 12, to allow the first blocking part 73*a* to more easily tilt up or bend and deform when the liquid storage cavity 12 is under the negative pressure, strength-reducing grooves 74*a* respectively located in two sides of the first blocking part 73*a* in a thickness direction are provided on the flexible silicone base 70*a*, and most part of the first blocking part 73*a* is hung or in a hung state through the strength-reducing grooves 74*a*, to more facilitate tilting or bending and deformation. Certainly, in a variable embodiment, the strength-reducing grooves 74*a* may be replaced with a plurality of hollow holes, and connection areas between the first blocking part 73*a* and other parts of the flexible silicone sleeve are reduced through the holes, to reduce the anti-bending strength of the first blocking part, thereby facilitating easy deformation of the first blocking part.

In still another preferred embodiment shown in FIG. 14, the strength-reducing structures 74*b* surrounding a first blocking part 73*b* in a flexible silicone base 70*b* may be structures such as holes or grooves close to or surrounding the first blocking part 73*b* or notches extending outward from the first liquid guide channel 71, and all the structures are to reduce the anti-bending strength of the first blocking part 73*b*, making it easier to tilt and deform. Similarly, a recess 741*b* may further be arranged on the first blocking part 73*b*, to also reduce the anti-bending strength of the first blocking part 73*b*.

Certainly, in the preferred embodiments shown in FIG. 12 and FIG. 14, the first blocking parts 73/73*a* form a structure that is hung and connected to other parts of the flexible silicone bases 70/70*a* shown in the figure through the structures such as the grooves or notches surrounding the first blocking parts, which is easier to deform such as tilt or bend.

Figure 15:
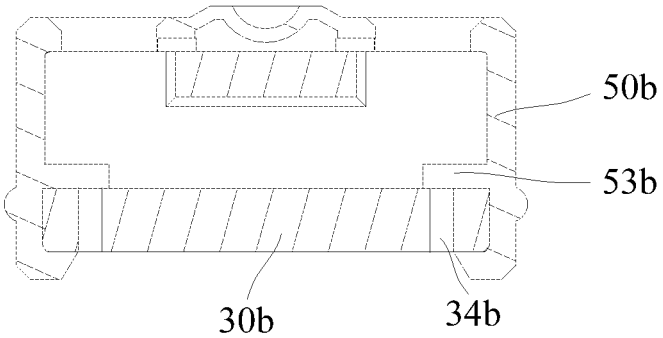
FIG. 15 is a schematic cross-sectional view of a porous body and a flexible silicone sleeve according to still another embodiment.
Figure 16:
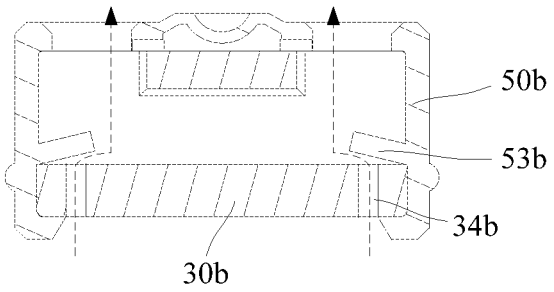
FIG. 16 is a schematic diagram in which the flexible silicone sleeve is deformed to open an air channel in FIG. 15.

Alternatively, in still another optional embodiment shown in FIG. 15 and FIG. 16, a channel for replenishing air to the liquid storage cavity 12 is formed on a porous body 30*b*. Specifically, in FIG. 15 and FIG. 16, a hole 34*b* running through the vaporizer 100 in the length direction is provided on the porous body 30*b*, and the hole 34*b* is used as the channel for replenishing air to the liquid storage cavity 12. A third blocking part 53*b* extending in the cross section direction of the vaporizer 100 and blocking the hole 34*b* is correspondingly provided on a flexible silicone sleeve 50*b*. The third blocking part 53*b* may tilt upward or bend and deform in response to the negative pressure of the liquid storage cavity 12, to open the hole 34*b*, so as to enable the external air to be replenished to the liquid storage cavity 12.

Alternatively, in another variant embodiment in FIG. 15 and FIG. 16, an air channel is formed between the porous body 30*b* and the flexible silicone sleeve 50*b*, for example, a groove structure on the porous body 30*b* and/or an inner wall of the flexible silicone sleeve 50*b*.

Figure 17:
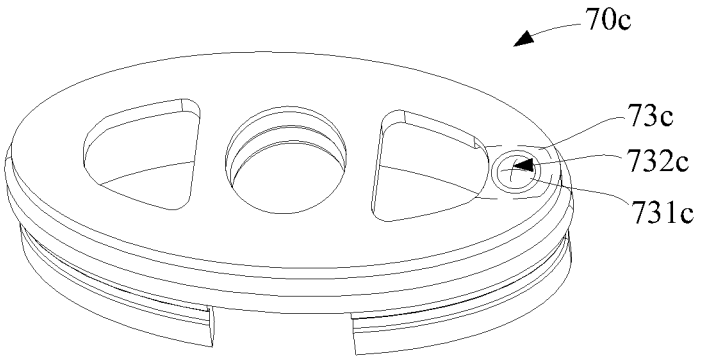
FIG. 17 is a schematic structural diagram of a flexible silicone base according to still another embodiment.

FIG. 17 is a schematic structural diagram of a flexible silicone base 70*c* according to another optional embodiment. The flexible silicone base is provided with a first blocking part 73*c* for blocking the through hole 63 on the support frame 60. At least a part of the blocking part 73*c* opposite to an opening of the through hole 63 forms a protrusion 731*c* deviating from the through hole 63 to the liquid storage cavity 12. Then, a cut or a slit 732*c* may be formed on the protrusion 731*c* through cutting or scratching. In a non-inhalation state, the cut or slit 732*c* is closed when the first blocking part 73*c* is subject to a pressure of the liquid substrate. During inhalation, when the negative pressure in the liquid storage cavity 12 is gradually increased to a certain extent, the cut or slit 732*c* can be enlarged, to open the opening of the through hole 63, so as to replenish air to the liquid storage cavity 12.

Figure 18:
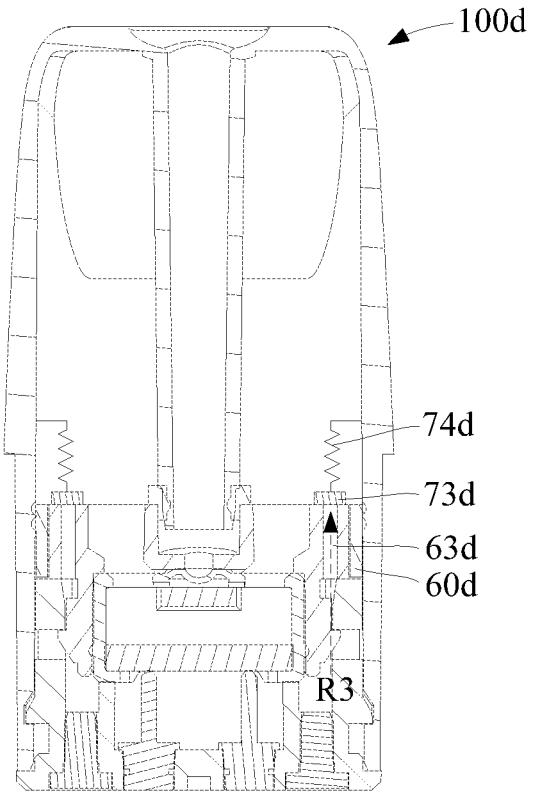
FIG. 18 is a schematic sectional structural view of a vaporizer according to still another embodiment.

Alternatively, in another optional embodiment, FIG. 18 shows a schematic structural diagram of another vaporizer 100*d*. A through hole 63*d* of a support frame 60*d* is used as a channel for replenishing air to the liquid storage cavity 12. A flexible blocking plug 73*d* for blocking the through hole 63*d* is arranged on an opening of the through hole 63*d*, and the blocking plug 73*d* abuts against the through hole 63*d* through an elastic force of a spring element 74*d*. During inhalation, the negative pressure inside the liquid storage cavity 12 is gradually increased to a certain extent, and an external air pressure is greater than the elastic force of the spring element 74*d*, the blocking plug 73*d* is flushed, to allow external air to enter the liquid storage cavity 12. When the negative pressure inside the liquid storage cavity 12 is reduced to a certain extent, the elastic force of the spring element 74*d* allows the blocking plug 73*d* to close the through hole 63*d* again.

According to the vaporizer and the e-cigarette, a flexible silicone component can be elastically deformed in response to the negative pressure in the liquid storage cavity due to flexibility, so as to open the air channel, so that the external air can pass through the air channel and enter the liquid storage cavity to partially relieve a negative pressure degree, so as to smoothly convey the liquid substrate.

Certainly, in the foregoing embodiments, the flexible component has a deformation resistance capability, to allow the air channel inside the liquid storage cavity 12 to be in a normally closed state during non-inhalation during use, so that the liquid storage cavity 12 is maintained in a specific negative pressure state. During inhalation, only when the negative pressure inside the liquid storage cavity 12 is increased to exceed a specific critical threshold, the flexible component is deformed in response to the change of the negative pressure for air to enter. Therefore, a case that the liquid storage cavity 12 is not in a constant normal pressure state can be prevented, and the liquid substrate can be prevented from leaking through the porous body 30.

Figure 19:
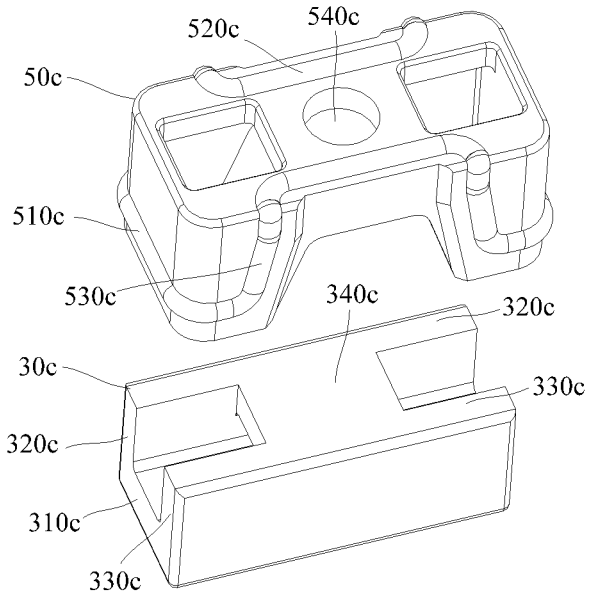
FIG. 19 is a schematic structural diagram of another flexible silicone sleeve cooperating with a porous body to perform sealing.

Further, an embodiment shown in FIG. 19 provides a structure of a porous body 30*c* and a flexible silicone sleeve 50*c* having a better sealing effect and preventing the liquid substrate from leaking between joint gaps of various components. Specifically, the porous body 30*c* includes:

a base part 310*c* extending in the cross section direction of the vaporizer 100, where an upper surface and a lower surface of the base part 310*c* may be respectively used as the liquid absorbing surface and the vaporization surface; and a first extending arm 320*c* and a second extending arm 330*c*, where the base part 310*c* extends in a length direction of the vaporizer 100 to form the first extending arm and the second extending arm. In a preferred embodiment shown in FIG. 19, the first extending arm 320*c* and the second extending arm 330*c* are respectively arranged on two opposing sides of the base part 310*c* in a thickness direction of the vaporizer 100.

Further, in a preferred embodiment shown in FIG. 19, the porous body 30*c* further includes a support part 340*c* extending between the first extending arm 320*c* and the second extending arm 330*c* in the cross section direction of the vaporizer 100.

A flexible silicone sleeve 50*c* is substantially in a shape of a hollow cylinder and wraps outside the porous body 30*c*.

A plurality of convex ribs for improving a sealing effect after being mounted are arranged on an outer surface of the flexible silicone sleeve 50*c*. The convex ribs are mainly to seal liquid substrate conveying channels between the support frame 60 and the porous body 30*c*, to prevent leakage from a gap between the support frame 60 and the porous body 30*c* during liquid conveying. Therefore, in this embodiment, the plurality of convex ribs form a closed ring together, and completely surround or enclose the conveying channel, thereby achieving a better sealing effect. Specifically, the plurality of convex ribs include:

a first convex rib 510*c*, where two sections of first convex ribs are respectively arranged on two outer side walls of the flexible silicone sleeve 50*c* in a width direction; the first convex rib 510*c* extends in a thickness direction in the figure; and the first convex rib 510*c* corresponds to or overlaps with the base part 310*c* of the porous body 30*c* at an assembled position, so that the first convex rib 510*c* can support the base part 310*c*, and the first convex rib 510*c* can closely abut against the inner wall of the support frame 60;

a second convex rib 520*c*, where two sections of second convex ribs are respectively arranged on two sides of a top wall surface of the flexible silicone sleeve 50*c* close to the thickness direction; and the two sections of second convex ribs are configured to extend in a width direction and are respectively opposite to the support part 340*c* at the position, so that after being mounted, the two sections of second convex ribs can be supported by the support part 340*c*, and the second convex rib 520*c* can tightly abut against the inner wall of the support frame 60; and a third convex rib 530*c*, where four sections of third convex ribs are respectively arranged on two outer side walls of the flexible silicone sleeve 50*c* in the thickness direction (two sections of three convex ribs 530*c* in an opposing side in the figure are blocked and are not displayed); a first end of the third convex rib in the length direction is connected to the first convex rib 510*c*, and a second end of the third convex rib is connected to the second convex rib 520*c*; and after being mounted, the third convex rib 530*c* supports outer side walls of the first extending arm 320*c* and the second extending arm 330*c*, so that the third convex rib 530*c* tightly abut against the inner wall of the support frame 60.

According to the preferred embodiment in FIG. 19, there are a total of four sections of three convex ribs 530*c*, and the first convex rib 510*c*, the second convex rib 520*c*, and the second convex rib 530*c* that are arranged on the flexible silicone sleeve 50*c* are connected to form a closed shape. Certainly, the closed shaped formed by the convex ribs is a non-planar closed ring with a span in the length direction of the vaporizer 100.

In addition, according to the preferred embodiment in FIG. 19, the third convex rib 530*c* is obliquely arranged outward in the width direction.

Further, in a preferred embodiment shown in FIG. 19, a bearing hole 540*c* located between two opposing second convex ribs 520*c* is provided on the flexible silicone sleeve 50*c*. In this embodiment, the bearing hole 540*c* is opposite to the through hole 651 on the rigid support frame 60, so that condensate of the aerosol conveying the vapor conveying tube 11 can fall down into the bearing hole and is received and absorbed by the support part 340*c* through the bearing hole 540*c*.

Figure 20:
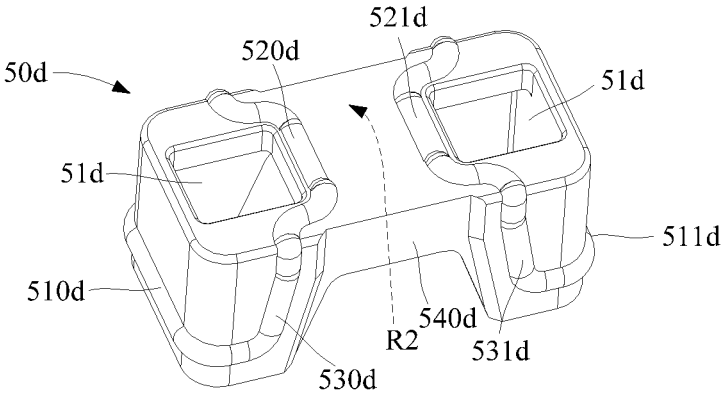
FIG. 20 is a schematic structural diagram of another flexible silicone sleeve cooperating with a porous body to perform sealing.

FIG. 20 is a schematic diagram in which a flexible silicone sleeve 50*d* is provided with convex ribs to improve a sealing effect according to another optional embodiment. In this embodiment, two convex ribs are separated from each other and are in closed rings. Specifically, a first convex rib 510*d* arranged on a side wall in a width direction, a second convex rib 520*d* arranged at the top, and two sections of third convex ribs 530*d* located on two side walls in a thickness direction form a first closed ring.

Similarly, another fourth convex rib 511*d*, fifth convex rib 521*d*, and two sections of sixth convex ribs 531*d* form a second closed ring.

Certainly, the closed rings formed by the plurality of convex ribs are independent of each other and are symmetrically arranged on the flexible silicone sleeve 50*d* in the width direction and the thickness direction.

In a convex rib structure arrangement of a preferred embodiment shown in FIG. 20, two symmetrical closed rings respectively surround two fluid communication openings 51*d*, to prevent the liquid substrate from leaking from the gap between the support frame 60 and the porous body 30*c* during conveying.

In addition, according to the preferred embodiment shown in FIG. 20, a channel part 540*d* formed through a recess for the aerosol to output during inhalation is provided on two sides of the flexible silicone sleeve 50*d* in the thickness direction, to form a part of an airflow path R2 during inhalation. The corresponding third convex ribs 530*d* and sixth convex ribs 531*d* are respectively arranged on two sides of the channel part 540*d*.

Further, according to the preferred embodiments shown in FIG. 19 and FIG. 20, extending paths of the convex ribs that form the closed rings completely pass through the entire outer surface of the flexible silicone sleeve 50*c*/50*d*, that is, a part of the closed rings extends in the left and right outer side walls in the width direction, the front and rear outer side walls in the thickness direction, and the outer surface of the top wall of the flexible silicone sleeve 50*c*/50*d*.

Figure 21:
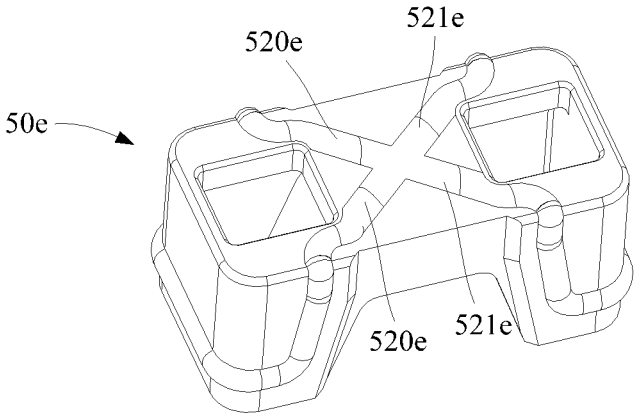
FIG. 21 is a schematic structural diagram of a flexible silicone sleeve cooperating with a porous body to perform sealing.

In another optional embodiment shown in FIG. 21, in convex ribs forming two closed rings of a flexible silicone sleeve 50*e*, a second convex rib 520*e* includes two parts at an angle; and a corresponding fifth convex rib 521*e* similarly includes two parts at an angle.

Certainly, in the flexible silicone sleeve 50*e* shown in FIG. 21, both the second convex rib 520*e* and the fifth convex rib 521*e* are similarly supported by the support part 340*c*.

In addition, in this embodiment shown in FIG. 21, in the flexible silicone sleeve 50*e* shown in FIG. 21, the two closed rings formed by a plurality of sequentially connected convex ribs may be connected.

In addition, in the preferred embodiments shown in FIG. 19 to FIG. 21, the plurality of convex ribs are symmetrically arranged in the thickness direction or the width direction of the vaporizer 100.

The e-cigarette vaporizer adopts a structure correspondingly applicable to the porous body 30/30*c* with the support part 33/340*c*, the convex ribs corresponding to parts of the porous body 30/30*c* are arranged on the flexible silicone sleeve 50*c*/50*d*/50*e*, so that after the convex ribs are assembled, the porous body 30/30*c* can relatively completely and tightly can abut against the rigid support frame 60/60*a* and the liquid guide channel can be isolated, to improve the sealing effect.

It should be noted that, the specification of this application and the accompanying drawings thereof illustrate preferred embodiments of this application, but are not limited to the embodiments described in this specification. Further, a person of ordinary skill in the art may make improvements or modifications according to the foregoing description, and all of the improvements and modifications should all fall within the protection scope of the attached claims of this application.

What is claimed is:

1. An e-cigarette vaporizer, configured to vaporize a liquid substrate and generate an inhalable aerosol and comprising: a liquid storage cavity configured to store the liquid substrate; and further comprising:

an air channel, providing a flowing path for external air to enter the liquid storage cavity and provided with a communication opening for the external air to enter the liquid storage cavity;

a first sealing element, comprising a blocking part sealing the communication opening, wherein the blocking part is configured to open at least a part of the communication opening in response to a change of a negative pressure in the liquid storage cavity for the external air to enter the liquid storage cavity;

a porous body, provided with a liquid absorbing surface that is in fluid communication with the liquid storage cavity and absorbs the liquid substrate and a vaporization surface for the aerosol to release and escape; and a support frame, configured to accommodate and hold the porous body, wherein:

the first sealing element is configured to surround at least a part of an outer surface of the support frame; and the air channel is formed on the support frame or formed between the first sealing element and the support frame.

2. The e-cigarette vaporizer according to claim 1, wherein the blocking part is made of a flexible material and configured to generate elastic deformation in response to the change of the negative pressure in the liquid storage cavity and open the at least a part of the communication opening during deformation.

3. The e-cigarette vaporizer according to claim 2, wherein the blocking part of the first sealing element is easier to deform than other parts of the first sealing element.

4. The e-cigarette vaporizer according to claim 3, wherein the blocking part of the first sealing element is thinner than the other parts of the first sealing element, so that the blocking part is easier to deform.

5. The e-cigarette vaporizer according to claim 3, wherein a strength-reducing structure for reducing an anti-bending strength of the blocking part is arranged on the first sealing element, so that the blocking part is easier to deform.

6. The e-cigarette vaporizer according to claim 5, further comprising: a heating element configured to heat the liquid substrate to generate the aerosol, wherein:

a first liquid channel for the liquid substrate to flow from the liquid storage cavity to the heating element is provided on the first sealing element; and the blocking part is adjacent to the first liquid channel.

7. The e-cigarette vaporizer according to claim 5, wherein the strength-reducing structure comprises a recess arranged on the blocking part.

8. The e-cigarette vaporizer according to claim 2, wherein the deformation comprises tilting or bending or protruding in a direction deviating from the communication opening.

9. The e-cigarette vaporizer according to claim 1, wherein a cut or a slit that is enlarged when the blocking part is elastically deformed is provided on the blocking part.

10. The e-cigarette vaporizer according to claim 1, wherein the blocking part is hung relative to the other parts of the first sealing element.

11. The e-cigarette vaporizer according to claim 1, further comprising:

a porous body, provided with a liquid absorbing surface that is in fluid communication with the liquid storage cavity and absorbs the liquid substrate and a vaporization surface for the aerosol to release and escape; and a vaporization chamber, at least partially defined by the vaporization surface and in airflow communication with the external air, wherein:

the air channel is in airflow communication with the vaporization chamber, to allow air in the vaporization chamber to enter the liquid storage cavity during use.

12. The e-cigarette vaporizer according to claim 1, further comprising:

a porous body, provided with a liquid absorbing surface that is in fluid communication with the liquid storage cavity and absorbs the liquid substrate and a vaporization surface for the aerosol to release and escape; and a support frame, comprising:

an accommodating cavity, wherein the porous body is accommodated and maintained in the accommodating cavity; and a second liquid channel, wherein one end of the second liquid channel is in fluid communication with the liquid storage cavity, and an other end of the second liquid channel is in fluid communication with the liquid absorbing surface of the porous body, so that the liquid substrate in the liquid storage cavity is conveyed to the liquid absorbing surface of the porous body through the second liquid channel and absorbed by the liquid absorbing surface when the second liquid channel is used, wherein:

a first end of the air channel is in communication with the second liquid channel, and a second end of the air channel is in communication with the external air, so that the external air passes through the air channel and the second liquid channel and then enters the liquid storage cavity when the air channel is used.

13. The e-cigarette vaporizer according to claim 12, wherein the air channel comprises a first groove formed on an inner surface of the accommodating cavity, and one end of the first groove is in communication with the second liquid channel and an other end of the first groove is in communication with the external air.

14. The e-cigarette vaporizer according to claim 12, further comprising a second sealing element configured in the accommodating cavity and configured to wrap at least a part of an outer surface of the porous body.

15. The e-cigarette vaporizer according to claim 13, wherein the air channel comprises a third through hole running through from the vaporization surface to the liquid absorbing surface; and/or the air channel comprises a second groove or a gap between the porous body and a flexible element.

16. The e-cigarette vaporizer according to claim 1, wherein a thickness of the blocking part is between 0.2 mm and 0.5 mm and has a Shore Hardness A ranging from 20 A to 40 A.

17. The e-cigarette vaporizer according to claim 1, wherein at least a part of the first sealing element is configured to have a specific deformation resistance capability, so that an air pressure in the liquid storage cavity is less than an external air pressure.

18. An e-cigarette, comprising a vaporization apparatus and a power supply device for supplying power to the vaporization apparatus, wherein the vaporization apparatus comprises the e-cigarette vaporizer according to claim 1.

19. An e-cigarette vaporizer, configured to vaporize a liquid substrate and generate an inhalable aerosol and comprising: a liquid storage cavity configured to store the liquid substrate; and further comprising:

an air channel, providing a flowing path for external air to enter the liquid storage cavity; and a sealing element, comprising a blocking part sealing a communication opening, wherein the blocking part is configured to open at least a part of the communication opening;

wherein the blocking part is made of a flexible material and configured to generate elastic deformation and open at least a part of the communication opening during deformation;

a porous body, provided with a liquid absorbing surface that is in fluid communication with the liquid storage cavity and absorbs the liquid substrate and a vaporization surface for the aerosol to release and escape; and a heating element, coupled to the porous body and configured to heat the liquid substrate to generate the aerosol;

a support frame, configured to accommodate and hold the porous body;

wherein:

the sealing element is configured to surround at least a part of an outer surface of the support frame; and the air channel is formed on the support frame or formed between the sealing element and the support frame.

* * * * *